US005748094A

United States Patent [19]

Neathway et al.

[11] Patent Number: 5,748,094

[45] Date of Patent: May 5, 1998

[54] SWITCH WITH CURRENT FLOW DETECTOR

[75] Inventors: Graham Neathway, Almonte; Bill Kiss, Ottawa, both of Canada

[73] Assignee: Ridgeway Research Corporation, Kanata, Canada

[21] Appl. No.: 721,220

[22] Filed: Sep. 26, 1996

[51] Int. Cl.[6] ..... G08B 21/00

[52] U.S. Cl. ..... 340/660; 340/331; 340/332; 340/825.17; 340/815.45; 315/119; 315/129; 315/135

[58] Field of Search ..... 340/331, 332, 340/815.42, 815.49, 825.17, 815.45, 660; 315/119, 129, 135

[56] References Cited

U.S. PATENT DOCUMENTS 3,119,046 1/1964 Usher ..... 315/129
4,038,582 7/1977 Horwinski ..... 315/129
4,479,170 10/1984 Richardson ..... 362/95
5,017,837 5/1991 Hanna et al. ..... 315/119
5,170,068 12/1992 Kwiatkowski et al. ..... 307/31

*Primary Examiner*—Jeffery Hofsass
*Assistant Examiner*—Timothy Edwards, Jr.
*Attorney, Agent, or Firm*—Marks & Clerk

[57] ABSTRACT

A switch for use in an AC circuit wired in a three-way switch mode for supplying power to a load, has a first terminal for connection to an external line, second and third terminals for connection respectively to corresponding terminals of a second like switch, and a switch contact for selectively connecting the first terminal to either one of the second and third terminals. A transformer has its primary winding connected between the first terminal and the external line, and its secondary winding deriving an output voltage therefrom. The output voltage is rectified and supplied to a light-emitting diode. The ratio of turns of the windings of the transformer is such that the rectified voltage energizes the light-emitting diode when power is supplied to the load over its normal operating range. The light-emitting diode will thus provide an indication of when power is supplied to the load.

4 Claims, 1 Drawing Sheet

DIAG. B

SWITCH WITH CURRENT FLOW DETECTOR

BACKGROUND OF THE INVENTION

This invention relates to a switch with a current flow detector for use in a circuit configuration including two switches wired in a three-way switch mode.

Three-way switch circuits have been known for many years. They are often found in the home, for example, between the hall and landing. The idea is that the user can switch the landing light on or off from either floor. The problem with such circuits, and a source of constant irritation to many users, is that if the landing light is not visible from the Hall, it is impossible to know whether it is switched on or off, or has burnt out.

This problem has been addressed in the prior art. For example, U.S. Pat. No. 3,119,046 describes a pair of impedances connected across the two wires interconnecting the respective terminals of a pair of switches forming part of the three-way circuit. An indicating device is connected between the junction of the pair of impedances and the output conductor. One problem with this arrangement is that it constantly consumes a small amount of current when the circuit is in the off configuration. Also, the indicating device is activated when the circuit is off, which is illogical. The natural requirement is to have the indicator device become energized when the circuit is on.

Any indicator device must be small enough to fit onto a conventional switch plate. It should have minimal power consumption, be simple to make, and not require an independent power source.

U.S. Pat. No. 4,038,582 describes an internally illuminated switch plate. This patent describes an arrangement whereby a neon lamp is connected across the terminals of the switch. Like the arrangement above, the neon lamp is turned on when the switch is turned off because only in that configuration does a voltage appear across the switch terminals.

An object of the present invention is to provide a switch capable of indicating when a three-way circuit is in the on-mode. The invention is also applicable to single switch configurations.

SUMMARY OF THE INVENTION

According to the present invention there is provided a switch arrangement for use in an AC circuit wired in a three-way switch mode for supplying power to a load, comprising a first terminal for connection to an external line, second and third terminals for connection respectively to corresponding terminals of a second like switch, and a switch contact for selectively connecting said first terminal to either one of second and third terminals; a transformer having a primary winding connected between said first terminal and said external line, and a secondary winding deriving an output voltage therefrom; a rectifier deriving a rectified voltage from said output voltage; and a light-emitting diode receiving said rectified voltage from said rectifier; the ratio of turns of said windings of said transformer being such that said rectified voltage energizes said light-emitting diode when power is supplied to said load over its normal operating range.

The transformer should have a low impedance primary winding that has minimal effect on the current flowing to the load. A transformer capable of driving an LED can be made sufficiently small to fit conveniently onto a switch plate of a standard electric light switch.

The invention allows the indicator device to be energized directly by the current flowing through the switch when the circuit is in the on configuration. The current drain is very small and only present when the circuit is switched on. The indicator device can be easily made small enough to fit onto a conventional switch plate.

In a preferred embodiment, a current limiting device is provided to limit the current flowing through the light-emitting diode to a safe value.

In another aspect, the invention provides a switch arrangement for use in an AC circuit, comprising a first terminal for connection to one part of an external line, a second terminal for connection to another part of said external line, a third terminal, and a switch contact for selectively connecting said first terminal to said third terminal; a transformer having a primary winding connected between said second terminal and said third terminal, and a secondary winding deriving an output voltage therefrom; a rectifier deriving a rectified voltage from said output voltage; and a light-emitting diode receiving said rectified voltage from said rectifier; the ratio of turns of said windings of said transformer being such that said rectified voltage energizes said light-emitting diode when power is supplied to said load over its normal operating range.

BRIEF DESCRIPTION OF THE DRAWINGS

The invention will now be described in more detail, by way of example only, with reference to the accompanying drawings, in which.

DESCRIPTION OF THE PREFERRED EMBODIMENTS

Figure 1:
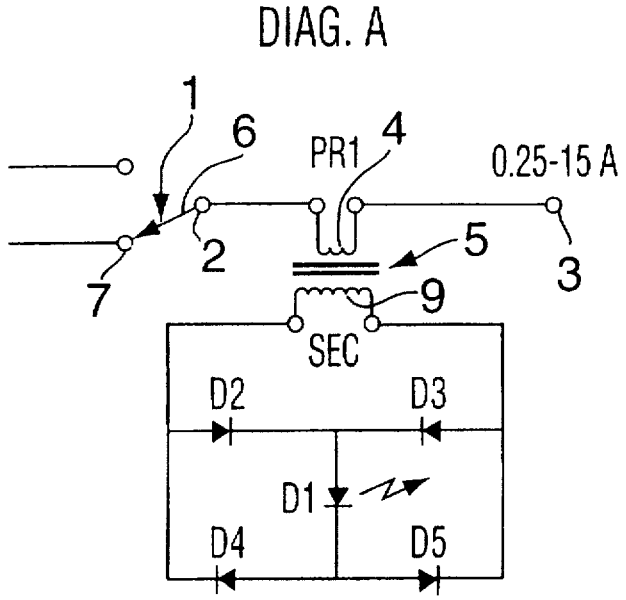
FIG. 1 is a circuit diagram of a switch in accordance with a first embodiment of the invention.

Referring now to FIG. 1, a switch generally referenced 1, designed for use on commercial power lines, has a first terminal 2 connected to an external terminal 3 through a primary winding 4 of a light-weight transformer 5. Switch 1 can be any form of single pole switch, such as a single pole, double throw switch or a single pole, single throw switch. The external terminal 3 is connected to a load or external power source, normally the mains voltage supply. First, terminal 2 can be selectively connected by switch contact 6 to either one of second and third terminals 7, 8. Terminals 7 and 8 are connected to corresponding terminals of a like switch (not shown) so as to form a three-way switch circuit. The "like switch" should, in this embodiment, be capable of switching in the three-way mode, but it is, of course, not necessary for it to include an indicator device according to the invention, although it may optionally do so.

When an AC current flows through the primary winding 4, a voltage is generated across secondary winding 9. This voltage, which is isolated from the main circuit, is in turn applied to opposite sides of a diode bridge consisting of diodes D2, D3, D4 and D5. A light-emitting diode D1 is connected between the junction of diodes D2 and D3, and D4 and D5. The diode bridge full wave rectifies the output voltage from the secondary winding 9, and applies the rectified voltage to the light-emitting diode D1, which in turn becomes energized. The diode bridge also provides a balanced load to the secondary winding of the transformer 5.

One of the requirements of an indicator device is that it should work over a wide current range, for example, 0.25–15 Amps. The minimum drive current required to energize the LED D1 is 4 ma. To provide a drive current to the LED D1 of 4 ma when the current in the primary winding is 0.25A requires a turns ration 1:64 for the transformer 4.

When an AC current is passed through the primary of transformer 5, a voltage $V_p$ will be generated across the primary due to the inductance of the primary $$V_p = 2\pi f L I$$

$L$ = Inductance of primary $I$ = AC current through the primary

The voltage across the primary, $V_p$, will be transferred to the secondary Vs in accordance with the ratio of the number of turns of the windings:

$$V_s = V_p \times T_s / T_p$$

In order to cause current to flow through the LED D1, $V_s$ must exceed the forward voltage of the two conducting diodes in the full-wave rectifier bridge and the forward voltage of LED D1.

$V_s$=VF(D3+D4+D1)

$V_s$=VF(0.6+0.6+1.5)

$V_s$=2.7V

In order to achieve the required voltage, the number of turns on the primary are set to provide a value of inductance, L, such that a primary current of 0.25A will result in a primary voltage of 4.2 mVAC.—this in turn will generate a secondary voltage $V_s$ of 2.7V.

Once the secondary voltage is sufficient to overcome the forward voltage of the diodes, the dynamic impedance of these elements is very low and the secondary current is a direct ratio of the primary current.

The secondary current is equal to

Sec Current=Primary Current×TP/TS=Primary Current/64

If the range of primary current is 0.25A to 15A then the secondary current is 0.25/64=0.004A to 15A/64=0.235A The maximum allowable current through the LED is 20 ma.

This is limited by the current limiter circuit as described with reference to FIG. 2.

Figure 2:
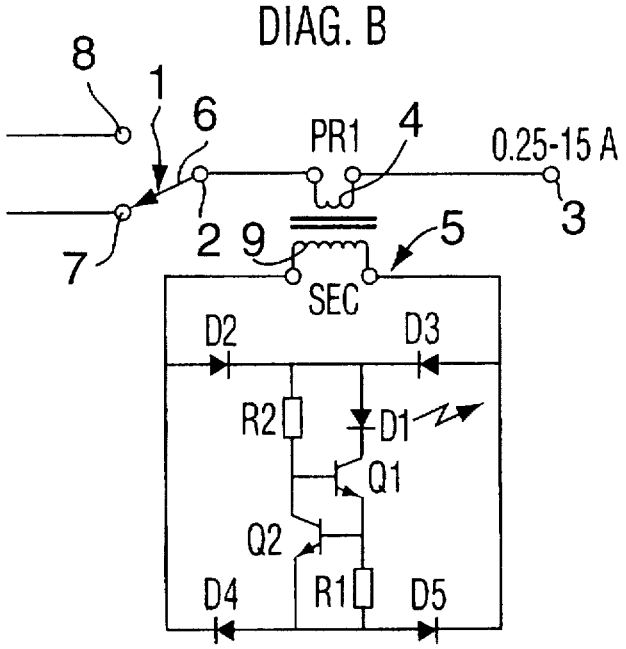
FIG. 2 is a circuit diagram of a second embodiment of the invention.

The embodiment shown in FIG. 2 operates in a similar manner to that shown in FIG. 1, except that in addition, a current limiting device is included. This consists of resistor R1 in series with transistor Q1 and diode D1. A voltage is developed across resistor R1 as current flows through it. The maximum allowable current through light-emitting diode D1 is 20 ma. Resistor R1 is chosen so that it will develop a voltage of 0.5 volts for a current of 20 ma.

Resistor R2 and transistor Q2 are arranged in parallel with the series combination of light-emitting diode D1, transistor Q1, and resistor R1.

When the voltage across resistor R1 reaches 0.50 Volts, transistor Q2 turns on, shunting the excess base current from transistor Q1, thereby limiting the current flowing through the diode D1.

The current passing through the primary winding will generate heat in the winding as a function of the primary winding DC resistance.

The primary resistance of the transformer should be low to ensure that the power dissipated in the transformer is within the limits of the transformer. In exemplary embodiment, the primary resistance was 5 milliohms, and therefore the maximum power dissipation is:

$$I^2R = 15^2 \times 5 \times 10^{-3} = 1.125 \text{ Watts}$$

The maximum power that can be dissipated by the transformer in its enclosed environment is 1.25 Watts.

It has been found that these requirements can be met with a transformer having a primary of 11 turns, a secondary of 704 turns, and a primary resistance of 1.4 milliohms.

Such a device has minimal power dissipation over the full operating range and is small enough to be packaged onto a conventional switch plate that can be fitted into standard outlet box. The device provides an indication when the load is switched on over a wide operating range and has an insertion loss of less than 0.01Ω.

Although the device has been described in connection with an AC circuit wired in a three-way switch mode, it can be used in a single switch configuration if desired. In that case, it is connected exactly as shown in the Figures except that the switch 1 is a conventional single pole switch. In this case, for example referring to FIG. 1, only the terminal 7 would be present and connected to one part of an external line. The contact 6 would make or break contact between terminal 7 and terminal 2, the primary 4 of transformer 5 being inserted between terminal 2 and terminal 3, which is connected to another part of the external line. The device detects current flow in exactly the same manner as in the embodiments described above. As in the three-way switch mode, the described arrangement has the advantage that the LED comes on when the device is in operation unlike the prior art where the indicator lamp comes on when the device is off.

We claim:

1. A switch arrangement for use in an AC circuit wired in a three-way switch mode for supplying power to a load, comprising:

a first terminal for connection to an external line, second and third terminals for connection respectively to corresponding terminals of a second like switch, and a switch contact for selectively connecting said first terminal to either one of second and third terminals;

a transformer having a primary winding connected between said first terminal and said external line, and a secondary winding deriving an output voltage therefrom;

a full-wave rectifier deriving a rectified voltage from said output voltage, said full-wave rectifier comprising two pairs of diodes arranged in a bridge;

a light-emitting diode receiving said rectified voltage from said rectifier;

a first series combination formed by said light-emitting diode, a first transistor and a resistor, said first series combination being connected between respective common points of each pair of diodes;

a current limiter provided by a second series combination formed by a second transistor and a second resistor, said second series combination being connected in parallel with said first series combination, a common point of said second transistor and said further resistor being connected to a base of said first transistor to shunt excess base current from said first transistor and thereby limit the current flowing through said light emitting diode; and the ratio of turns of said windings of said transformer being such that said rectified voltage energizes said light-emitting diode when power is supplied to said load over its normal operating range.

2. A switch arrangement as claimed in claim 1, wherein the primary winding of the transformer has about 11 turns, a resistance of about 5 milliohms, and the secondary winding has a about 704 turns.

3. A switch arrangement for use in an AC circuit, comprising:

a first terminal for connection to one part of an external line, a second terminal for connection to another part of said external line, a third terminal, and a switch contact for selectively connecting said first terminal to said third terminal;

a transformer having a primary winding connected between said second terminal and said third terminal, and a secondary winding deriving an output voltage therefrom;

a full-wave rectifier deriving a rectified voltage from said output voltage, said full-wave rectifier comprising two pairs of diodes arranged in a bridge;

a light-emitting diode receiving said rectified voltage from said rectifier;

a first series combination formed by said light-emitting diode, a first transistor and a resistor, said first series combination being connected between respective common points of each pair of diodes;

a current limiter provided by a second series combination formed by a second transistor and a second resistor, said second series combination being connected in parallel with said first series combination, a common point of said second transistor and said further resistor being connected to a base of said first transistor to shunt excess base current from said first transistor and thereby limit the current flowing through said light emitting diode; and the ratio of turns of said windings of said transformer being such that said rectified voltage energizes said light-emitting diode when power is supplied to said load over its normal operating range.

4. A switch arrangement as claimed in claim 3, wherein the primary winding of the transformer has about 11 turns, a resistance of about 5 milliohms, and the secondary winding has a about 704 turns.

* * * * *